US010494961B2

(12) United States Patent
Wigsten

(10) Patent No.: US 10,494,961 B2
(45) Date of Patent: Dec. 3, 2019

(54) CAMSHAFT DRIVEN PUMP FOR A HYDRAULIC CAM PHASER

(71) Applicant: BorgWarner Inc., Auburn Hills, MI (US)

(72) Inventor: Mark M. Wigsten, Lansing, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 16/019,172

(22) Filed: Jun. 26, 2018

(65) Prior Publication Data

US 2019/0003347 A1 Jan. 3, 2019

Related U.S. Application Data

(60) Provisional application No. 62/526,095, filed on Jun. 28, 2017.

(51) Int. Cl.

| | |
|---|---|
| ***F01L 1/344*** | (2006.01) |
| ***F01L 1/047*** | (2006.01) |
| ***F01L 13/00*** | (2006.01) |

(52) U.S. Cl.

CPC ..... *F01L 1/3442* (2013.01); *F01L 1/047* (2013.01); *F01L 1/344* (2013.01); *F01L 1/34409* (2013.01); *F01L 13/0036* (2013.01); *F01L 2001/0475* (2013.01); *F01L 2001/3443* (2013.01); *F01L 2001/34453* (2013.01); *F01L 2001/34469* (2013.01); *F01L 2013/0052* (2013.01)

(58) Field of Classification Search

CPC ..... F01L 1/3442; F01L 1/047; F01L 1/344; F01L 2001/0475; F01L 2001/3443; F01L 2001/34469

USPC ..... 123/90.17

See application file for complete search history.

(56) References Cited

U.S. PATENT DOCUMENTS

| | | | | |
|---|---|---|---|---|
| 8,307,794 | B2 | 11/2012 | Lengfeld et al. | |
| 8,474,421 | B2 | 7/2013 | Gregor et al. | |
| 9,121,311 | B2 | 9/2015 | Huerta et al. | |
| 9,228,456 | B2 | 1/2016 | Gross et al. | |
| 9,394,809 | B2 | 7/2016 | Gruber et al. | |
| 2012/0222635 | A1* | 9/2012 | Sunada | F01L 1/185 123/90.15 |
| 2016/0108770 | A1* | 4/2016 | Kobayashi | F01L 1/3442 123/90.17 |
| 2017/0159508 | A1 | 6/2017 | Kusanagi | |
| 2019/0112950 | A1* | 4/2019 | Nitz | F01L 1/044 |

* cited by examiner

*Primary Examiner* — Mark A Laurenzi
*Assistant Examiner* — Kelsey L Stanek
(74) *Attorney, Agent, or Firm* — Brown & Michaels, PC

(57) ABSTRACT

A mechanism provides high pressure fluid to a cam phaser on demand. The mechanism includes a positive displacement pump within the camshaft which is driven by a pin to compress and trigger fluid to be dispensed to the phaser.

23 Claims, 10 Drawing Sheets

CAMSHAFT DRIVEN PUMP FOR A HYDRAULIC CAM PHASER

REFERENCE TO RELATED APPLICATIONS

This application claims one or more inventions which were disclosed in Provisional Application No. 62/526,095, filed Jun. 28, 2017, entitled "CAMSHAFT DRIVEN PUMP FOR A HYDRAULIC CAM PHASER". The benefit under 35 USC § 119(e) of the United States provisional application is hereby claimed, and the aforementioned application is hereby incorporated herein by reference.

BACKGROUND OF THE INVENTION

Field of the Invention

The invention pertains to the field of variable cam timing. More particularly, the invention pertains to a camshaft driven pump for a hydraulic cam phaser.

Description of Related Art

Internal combustion engines have employed various mechanisms to vary the relative timing between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). Vane phasers have a rotor assembly with one or more vanes, mounted to the end of the camshaft, surrounded by a housing assembly with the vane chambers into which the vanes fit. It is possible to have the vanes mounted to the housing assembly, and the chambers in the rotor assembly, as well. The housing's outer circumference forms the sprocket, pulley or gear accepting drive force through a chain, belt, or gears, usually from the crankshaft, or possibly from another camshaft in a multiple-cam engine.

Apart from the camshaft torque actuated (CTA) variable camshaft timing (VCT) systems, the majority of hydraulic VCT systems operate under two principles, oil pressure actuation (OPA) or torsional assist (TA). In the oil pressure actuated VCT systems, an oil control valve (OCV) directs engine oil pressure to one working chamber in the VCT phaser while simultaneously venting the opposing working chamber defined by the housing assembly, the rotor assembly, and the vane. This creates a pressure differential across one or more of the vanes to hydraulically push the VCT phaser in one direction or the other. Neutralizing or moving the oil control valve to a null position puts equal pressure on opposite sides of the vane and holds the phaser in any intermediate position. If the phaser is moving in a direction such that valves will open or close sooner, the phaser is said to be advancing and if the phaser is moving in a direction such that valves will open or close later, the phaser is said to be retarding.

The torsional assist (TA) system operates under a similar principle with the exception that it has one or more check valves to prevent the VCT phaser from moving in a direction opposite than being commanded, should it incur an opposing force such as a torque impulse caused by cam operation.

At engine startup there is a lack of engine oil pressure available to the vane phasers, delaying the time from engine startup in which the relative timing between the camshaft and the crankshaft can be altered by the vane phaser.

SUMMARY OF THE INVENTION

A mechanism provides high pressure fluid to a cam phaser on demand. The mechanism includes a positive displacement pump within the camshaft which is driven by a pin to compress and trigger fluid to be dispensed to the phaser.

The compressed fluid can be delivered to the phaser at the time of engine startup or at times other than engine startup.

DETAILED DESCRIPTION OF THE INVENTION

Figure 1:
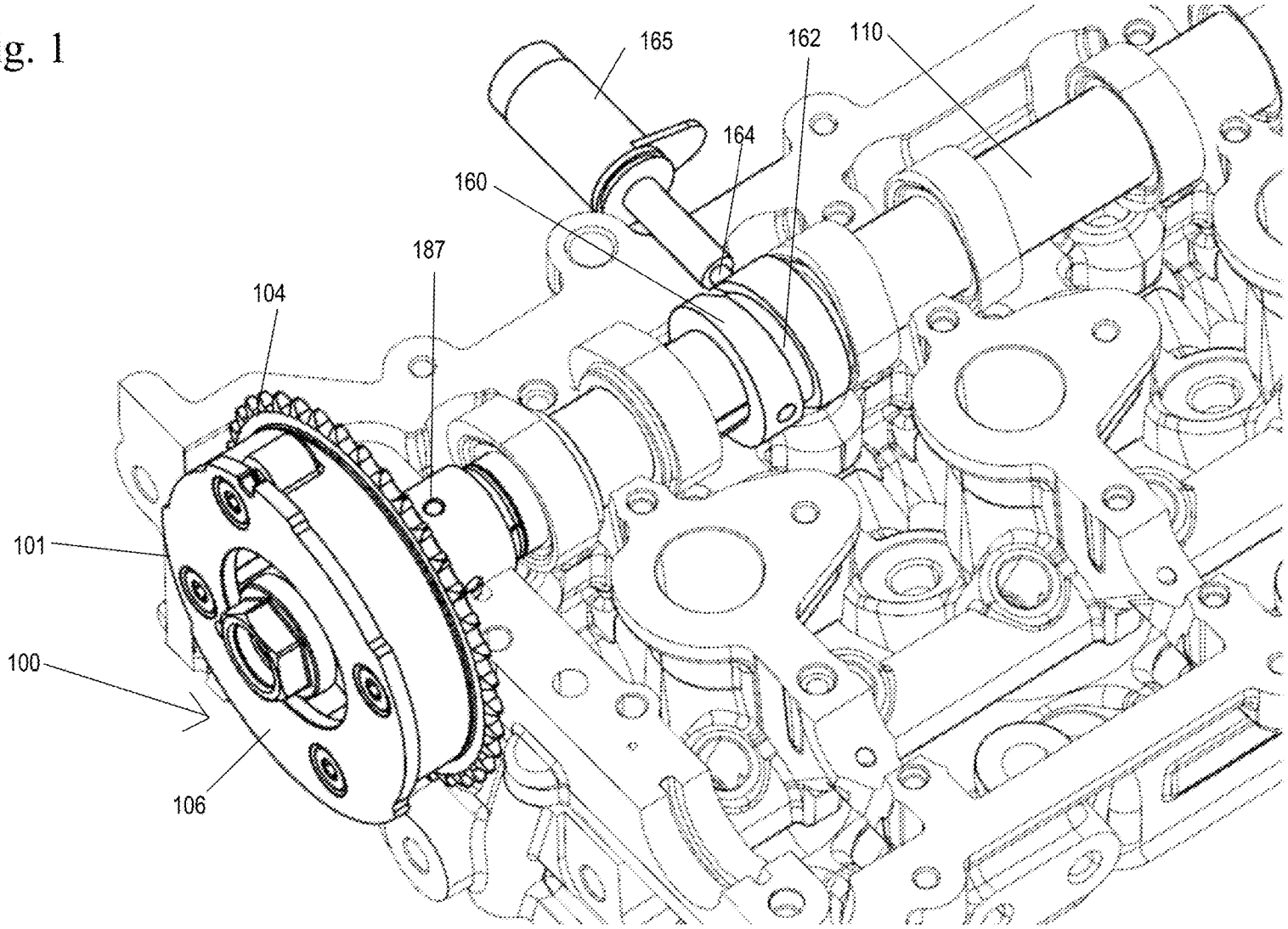
FIG. 1 shows the camshaft with the camshaft driven pump attached to the phaser within the engine.
Figure 2:
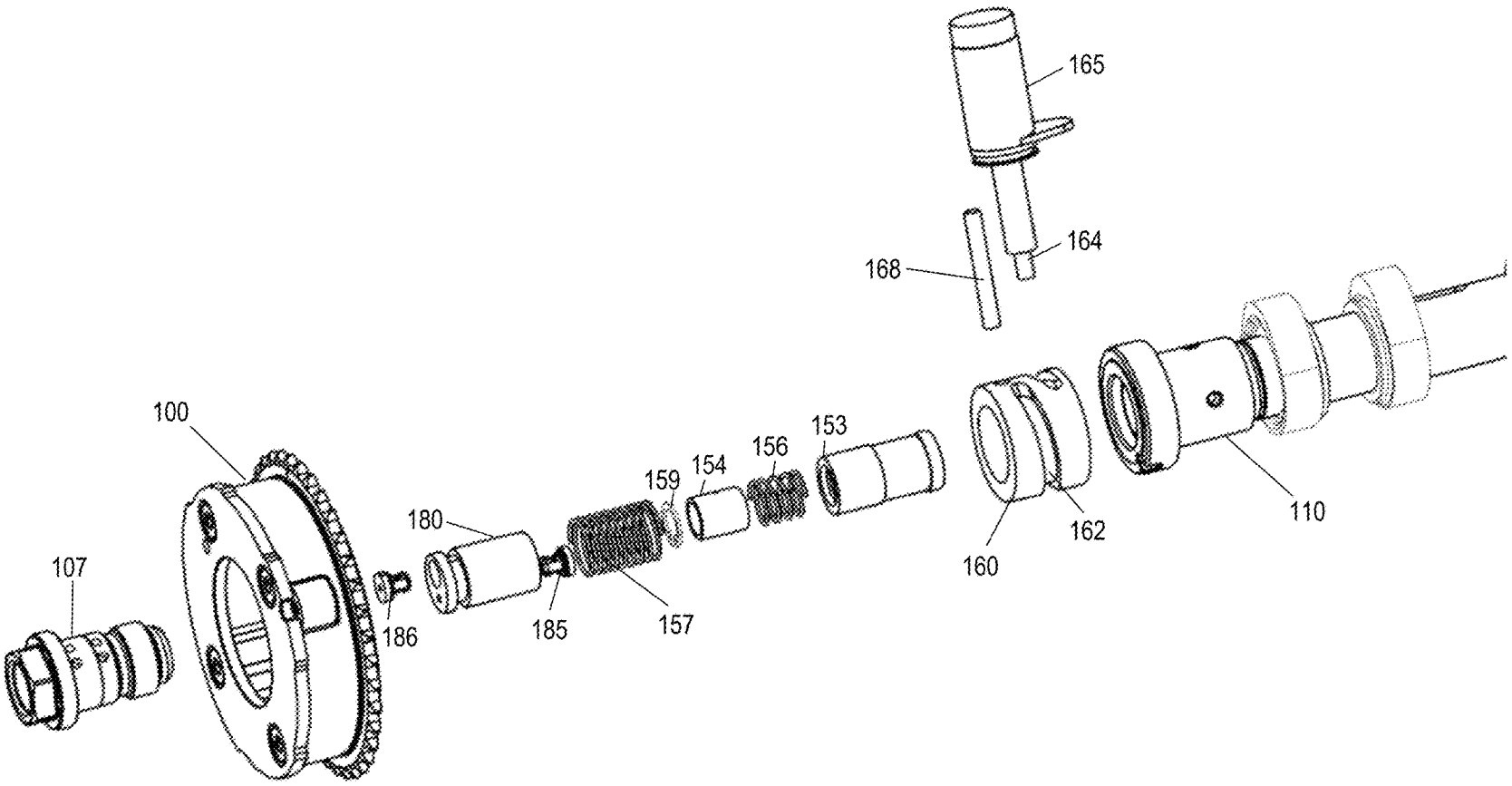
FIG. 2 shows an exploded view of the camshaft of the engine attached to the phaser with a camshaft driven pump.

Internal combustion engines have employed various mechanisms to vary the relative timing between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). As shown in FIGS. 1-5, vane phasers 100 have a rotor assembly 105 with one or more vanes, mounted to the end of a hollow camshaft 110, surrounded by a housing assembly 101 with the vane chambers 102, 103 into which one or more vanes (not shown) fit. The housing's outer circumference 104 may form the sprocket, pulley or gear accepting drive force through a chain, belt, or gears, usually from the crankshaft (not shown), or possibly from another camshaft in a multiple-cam engine. The housing assembly 101 preferably includes the end plates 106. A control valve 107 is received within the rotor assembly 105 of the phaser 100. In torsion assisted and oil pressure actuated phasers, the control valve 107 controls whether the phaser advances or retards the relative timing between the camshaft 110 and crankshaft (not shown). In the cam torque actuated phasers, the phaser uses cam torsionsals to recirculate fluid between the vane chambers to alter the relative timing between the camshaft 110 and the crankshaft (not shown).

To aid the phaser 100 during certain situations, for example at engine startup, a cam or camshaft driven pump 150 is present within the hollow camshaft 110.

Figure 3:
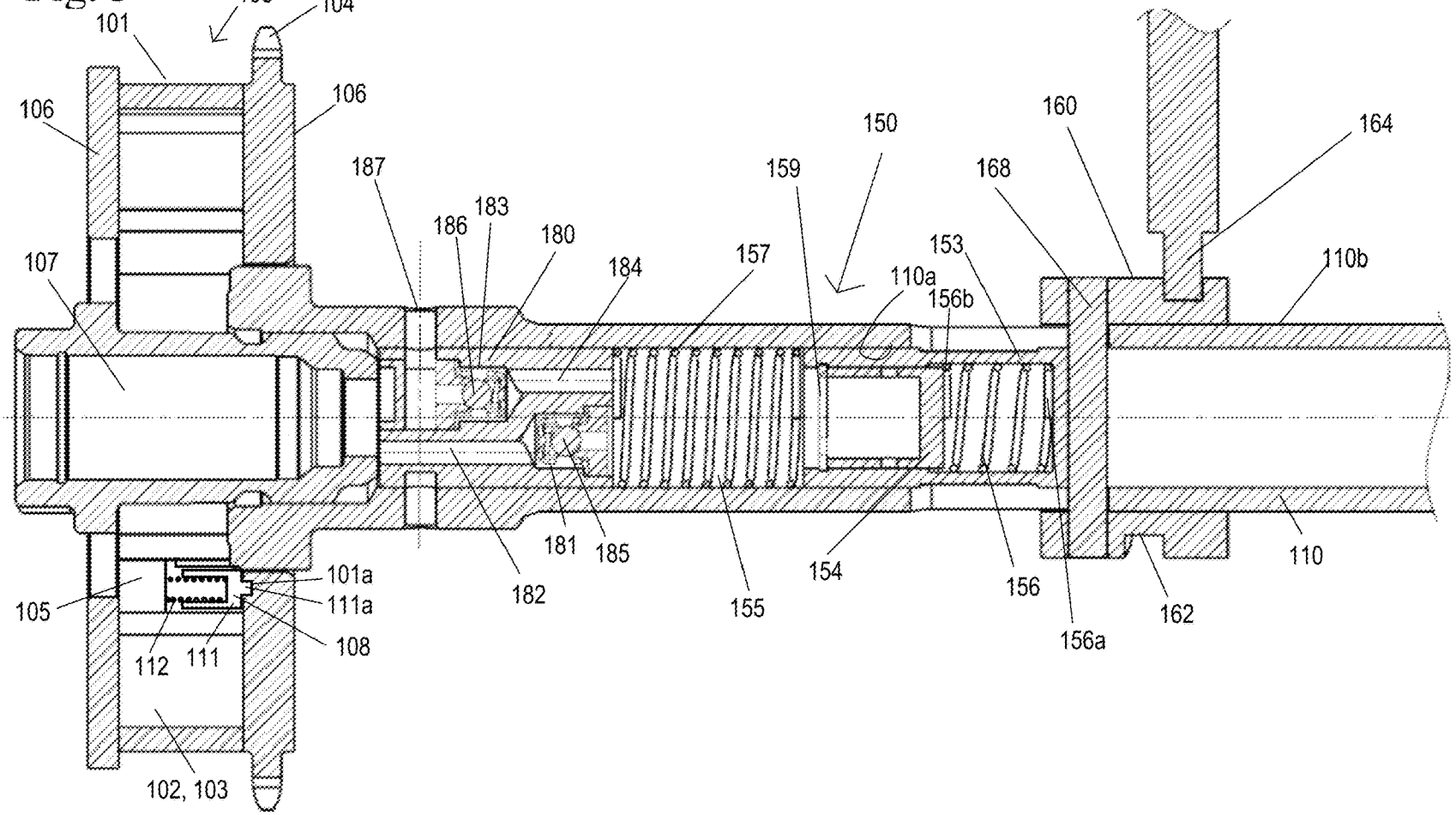
FIG. 3 shows a sectional view of the camshaft of the engine attached to the phaser with a camshaft driven pump.
Figure 4:
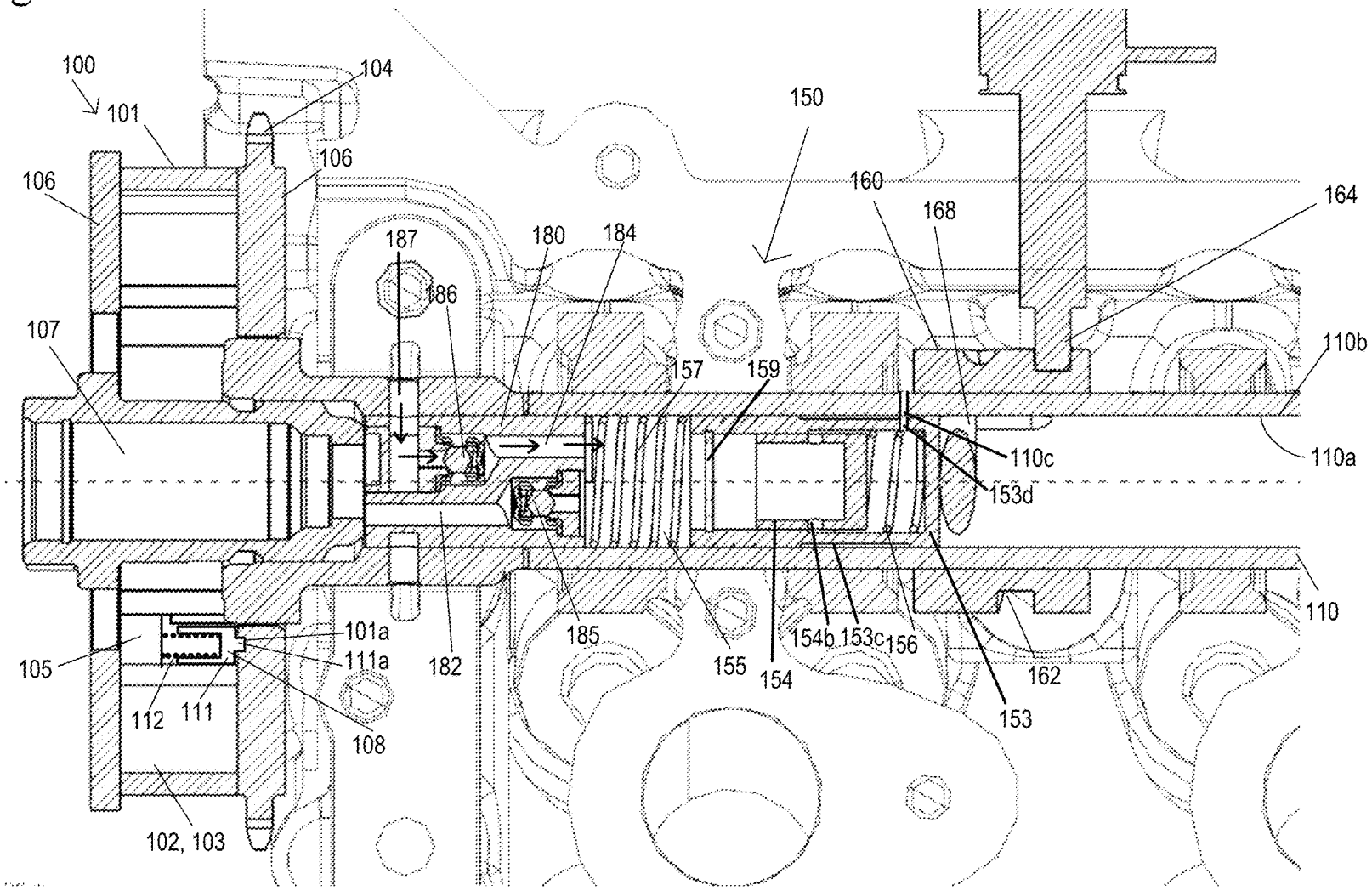
FIG. 4 shows a sectional view of the camshaft of the engine attached to the phaser with a camshaft driven pump in a compressed state.

In one embodiment, a cam or camshaft driven pump 150 provides a high pressure intake burst of oil to aid with an initial unlocking of a lock pin 108 of a cam torque actuated phaser 100, such that at engine startup, the initial unlocking of the lock pin 108 is conducted upon first rotation of the camshaft, allowing the phaser 100 to starting phasing instantly at engine startup. Referring to FIGS. 3-4, the lock pin 108 has a body 111 having an end 111*a* receivable in a pocket 101*a*. The lock pin 108 is biased towards the pocket 101*a* by a spring 112. The pocket 101*a* may be located in the rotor assembly 105 or the housing assembly 101. When the lock pin 108 engages the pocket 101*a*, the lock pin 108 locks the movement of the rotor assembly 105 relative to the housing assembly 101.

In another embodiment, a cam driven pump 150 provides a high pressure intake burst of oil to phase the torsion assisted or oil pressure assisted phaser 100 faster at engine startup.

In yet another embodiment, a cam driven pump 150 provides high pressure oil to phase the torsion assisted or oil pressure actuated phaser 100 faster at times other than engine startup. For example, conditions can exist where engine oil pressure supply is too low to provide for phaser motion at the desired rate. This can occur at a low engine speeds, or when a variable output oil pump is used. The cam driven pump 150 can provide a solution to the low engine oil problem.

Figure 8:
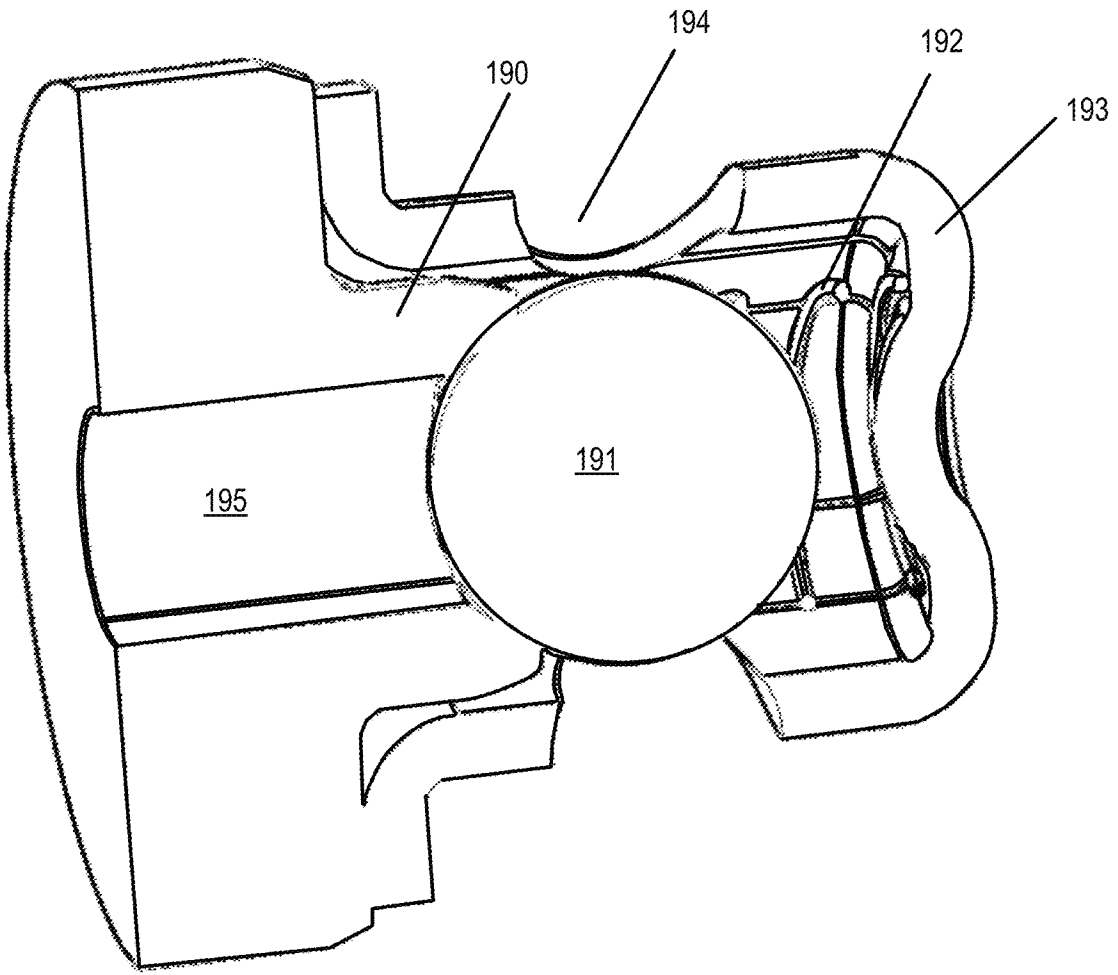
FIG. 8 shows a check valve received within the check valve housing.
Figure 9:
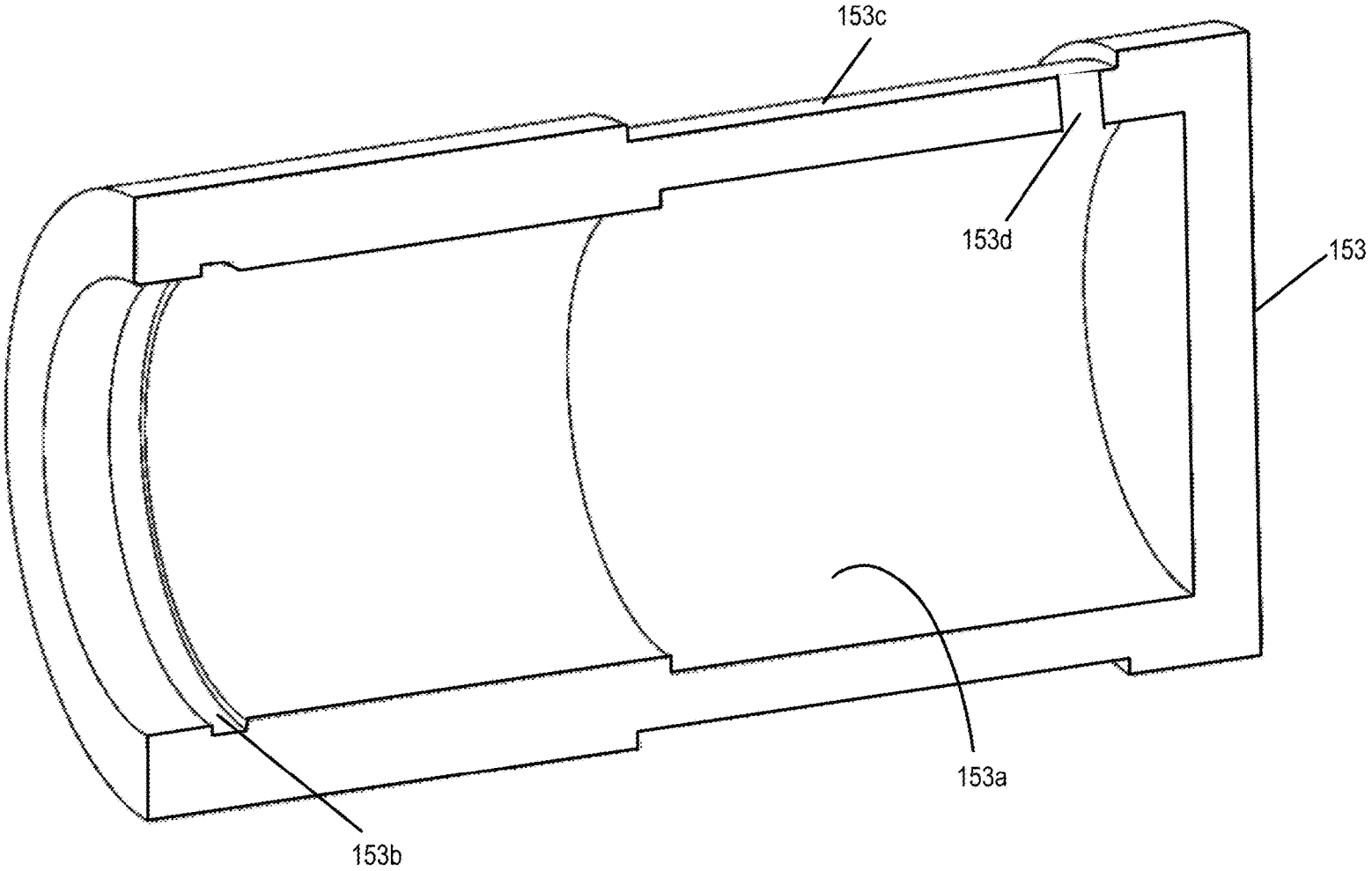
FIG. 9 shows an outer piston of the camshaft driven pump.
Figure 10:
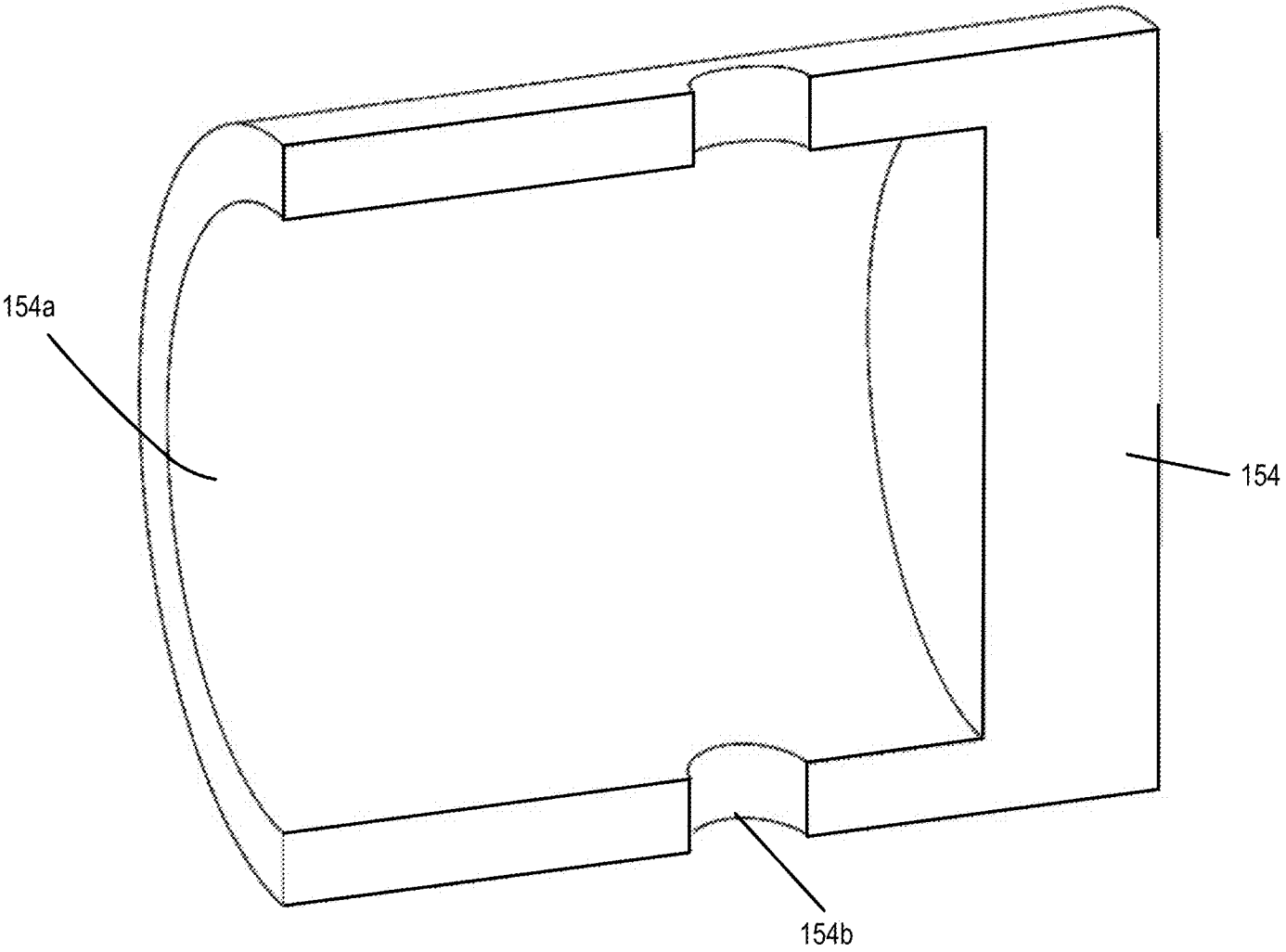
FIG. 10 shows an inner piston of the camshaft driven pump.

Referring to FIGS. 1-10 the cam driven pump 150 is a pump which is received within a hollow camshaft 110. The cam driven pump 150 includes a piston assembly of an outer piston 153 which receives a spring biased inner piston 154. The inner piston 154 is in fluid communication with a volume 155 formed between a check valve housing 180, the inner diameter 110*a* of the hollow camshaft 110, and the inner piston 154. FIG. 10 shows the inner piston 154. The inner piston 154 has an inner diameter 154*a* and an inlet 154*b*. The inner piston 154 is present within the outer piston 153 to prevent an over pressure condition such as might occur in FIG. 4. When this over pressure condition occurs, the inner piston 154 moves within the outer piston 153 such that the inlet 154*b* of the inner piston 154 is aligned with a vent 153*d* and an annulus 153*c* of the outer piston and therefore able vent to atmosphere through the camshaft 110 through vent 110*c*.

Figure 6:
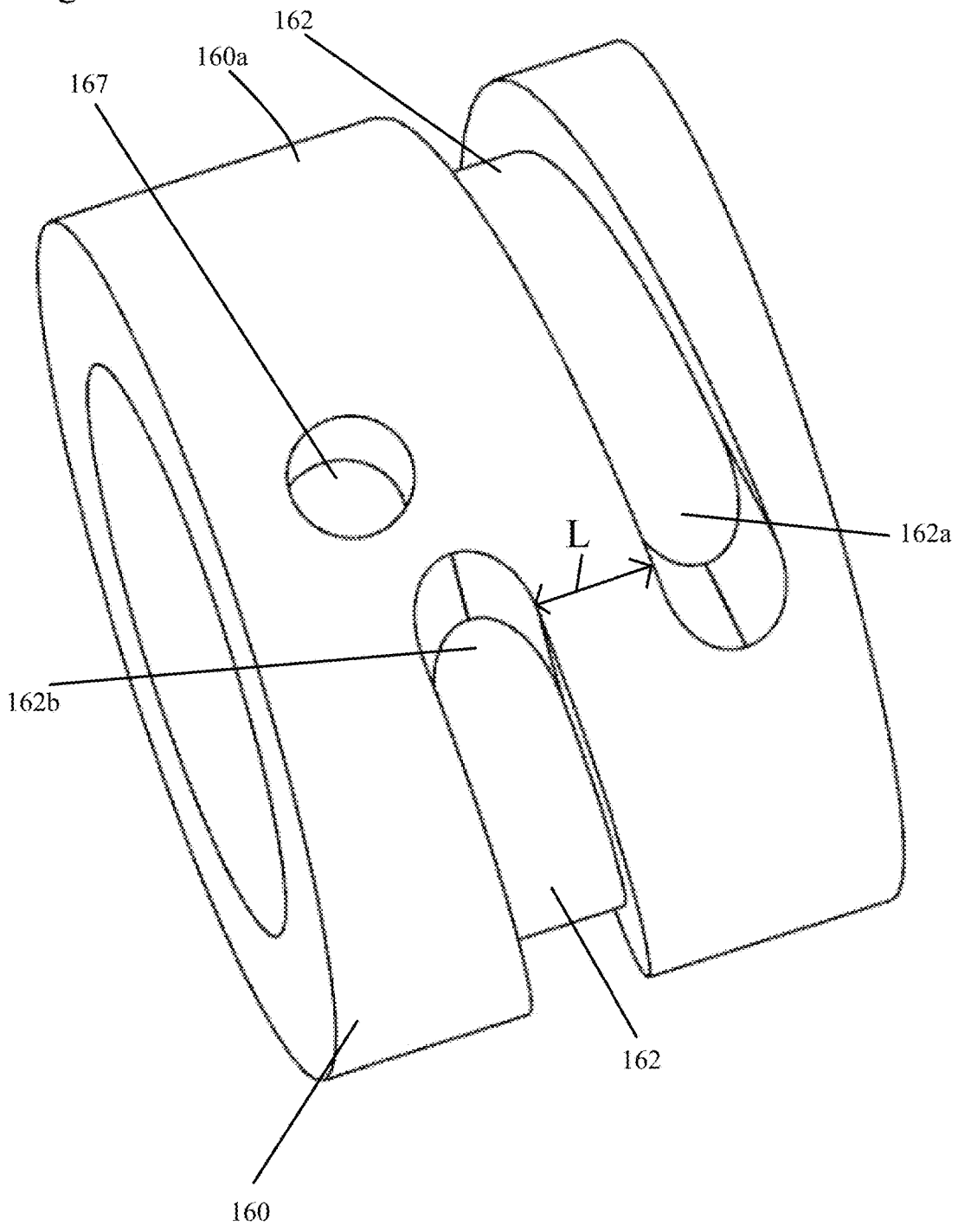
FIG. 6 shows a shift collar received on an outer circumference of the camshaft.

The movement of the outer piston 153 and the inner piston 154 is controlled by a shift collar 160 present on the outer circumference 110*b* of the hollow camshaft 110 through a connecting pin 168 received in a connecting pin bore 167. Referring to FIG. 6, the shift collar 160 has tracks or a helical groove 162 which circumscribes the outer circumference 160*a* of the shift collar 160 and in which a solenoid driven pin 164 rides within. The ends 162*a*, 162*b* of the groove 162 are separated on the outer circumference 160*a* of the shift collar by a distance L. Based on the portion of the groove or track 162 the pin 164, relative to the solenoid 165, is present in on the shift collar 160, the outer piston 153 of the pump 150 is actuated through the shift collar 160 to move a distance no greater than distance L. The solenoid pin 164 is controlled by a solenoid 165.

The inner piston 154 is spring biased away from the outer piston 153 by a first spring 156 which has a first end 156*a* connected to an end of the outer piston 153 and a second end 156*b* connected to an end of the inner piston 154. Another spring 157 is present between the check valve housing 180 and an end of the outer piston 153. Referring to FIG. 9, the inner circumference 153*a* of the outer piston 153 also has a groove 153*b* for receiver a stopper 159, which limits the movement of the inner piston 154 within the inner circumference 153*a* of the outer piston 153, which sets the maximum working pressure of the camshaft driven pump. The outer piston 153 additional has an annulus 153*c* on the outer circumference thereof.

Figure 7:
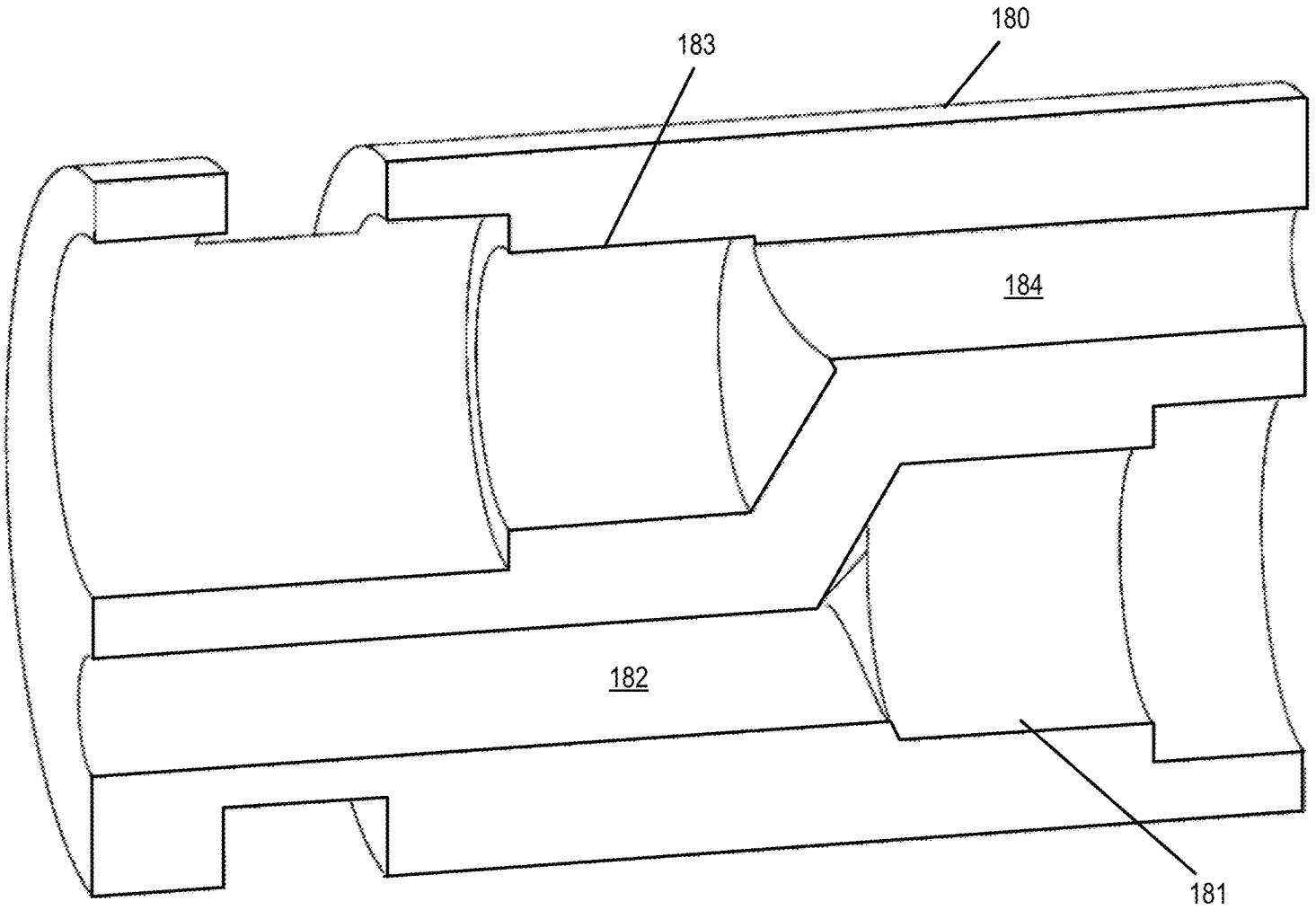
FIG. 7 shows a check valve housing received within the camshaft between the phaser and the camshaft drive pump.

The check valve housing 180 has a pair of bores 181, 183 connected to passages 182, 184 as shown in FIG. 7. Each of the bores 181, 183 receives a drop in check valve 185, 186. Referring to FIG. 8, the check valves 185, 186 each preferably include a valve seat 190 shaped to receive a moveable ball 191, a spring 192 and a cap 193. The spring 192 is present between the ball 191 and the cap 193. The check valves 185, 186 also each have an inlet 195 and an outlet 194. The inlet 195 is present within the valve seat 190 and the outlet is present within the cap 193. When the fluid pressure is received within the inlet 195 is great enough to overcome the force of the spring 192 on the ball 191, the ball 191 lifts off the valve seat 190 and fluid can flow directly from the inlet 195 to the outlet 194 of the cap 193 and to volume 155. When the force of the spring 192 is greater than the force of the fluid received by the inlet 195 of the valve seat 190, the ball 191 seats on the valve seat 190, preventing fluid from flowing from the inlet 195 to the outlet 194. Any fluid flowing in from the outlet 194 is prevented from flowing to the inlet 195 by the ball 191. While a ball check valve is shown, the ball can be replaced by any moveable object which can seat and seal with a valve seat.

The check valves 185, 186 are situated within the check valve housing 180 of hollow camshaft 110 such that oil from an inlet 187 of the camshaft 110 is received within the hollow camshaft 110 and can flow through the first check valve 185 to the volume 155 formed between the check valve housing 180 and the inner piston 154 via passage 184. The first check valve 185 prevents fluid from flowing to the phaser from the inlet 187 to the volume 155 through the check valve 183. A second check valve 186 is placed within the check valve housing 180 such that when fluid pressure of the fluid is high enough in the volume 155 and higher than the pressure in the phaser, the fluid in the volume 155 can flow through the second check valve 186 to the control valve 107. The second check valve 186 prevents back flow of fluid from the phaser to the volume 155. It should be noted that when the cam driven pump is not activated, since the first and second check valves 185, 186 are in series, fluid flows from supply inlet 187 through the check valves 185, 186 to the phaser 100. When the cam driven pump is actuated, oil in volume 155 is blocked from going back to supply 187 of the engine and is allowed to flow from volume 155 through the second check valve 186 and to the phaser 100.

When the solenoid 165 is energized, the solenoid 165 drives the solenoid pin 164 into the helical groove 162 of the shift collar 160 at an end 162*a*. As the solenoid pin 164 rides in the helical groove 162 from the first end 162*a* to the second end 162*b*, the groove 162 is shaped such that movement of the solenoid pin 164 in the helical groove 162 moves the shift collar 160 towards the phaser 100 and the connecting pin 168 moves the outer piston 153 against the force of the second spring 157.

Movement of the outer piston 153 against the force of the second spring 157, causes the inner piston 154 and the first spring 156 to move with the outer piston 153 until an over pressure condition exists. The position of the inner piston 154 is determined by the stopper 159.

When the solenoid driven pin 164 has engaged the helical groove 162, and the pressure of the oil within the volume 155 is great enough to overcome the spring force of the check valve spring 192 of the second check valve 186, the oil pressure moves the ball 191 away from the valve seat 190, a high pressure dose of oil is sent to the phaser through the second check valve 186 via the second check valve passage 182 in communication with the phaser 100 from the volume 155. In a preferred embodiment, the oil pressure sent to the phaser is approximately 100 to 200 psi. It should be noted that normal pressure of the oil in the phaser is approximately 30 psi. The pressure of the oil sent to the phaser depends on the preset pressure relief valve formed by the inner piston 154 and first spring 156. This pressure can be set to a level much higher than the normal engine oil pressure of the supply system.

If the solenoid driven pin 164 has traveled within the helical groove 162 and the outer piston 153 is moved a distance prior to the control valve 107 of the phaser 100 being moved to receive oil, the pressurized dose of oil is vented through the inner piston 153 and annulus 154*c* of the outer piston 154.

Figure 5:
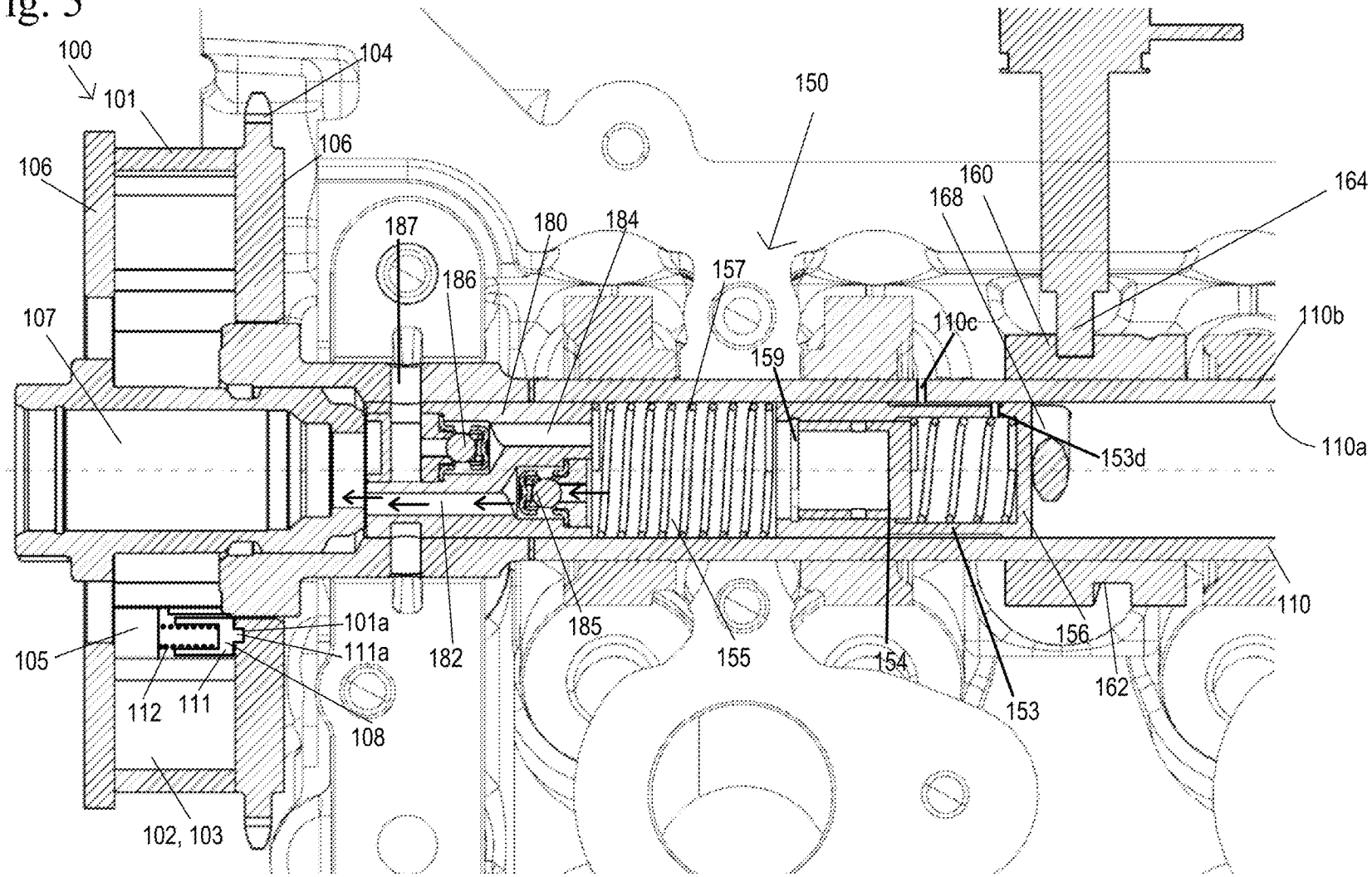
FIG. 5 shows a sectional view of the camshaft of the engine attached to the phaser with a camshaft driven pump in a decompressed state.

FIG. 5 shows a sectional view of the camshaft of the engine attached to the phaser with a camshaft driven pump 150 in a decompressed state after the dose of high pressure oil has been delivered to the phaser 100. To reset the shift collar 160, the solenoid driven pin 164 is removed from the helical groove 162 and the force of the second spring 157 moves the outer piston 153 and thus the shift collar 160, through the connection of the outer piston 153 with the connecting pin 168 of the shift collar 160. The reset position of the shift collar 160 is a position in which the solenoid driven pin 164 can enter the helical groove 162 at a helical groove end 162*a*. In this position, the volume 155 is no longer compressed.

It should be noted that the outer piston 153 can be moved the distance of the helical groove of the collar 160.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing system for an internal combustion engine comprising:

a hollow camshaft having an end coupled to a phaser, an inner circumference and an outer circumference, the inner circumference defining a volume of fluid;

an axially moveable shift collar received on the outer circumference of the camshaft, connected to the camshaft through a connecting pin, the shift collar having at least one helical track for receiving a driven pin, the shift collar being axially moveable through the driven pin; and a hydraulic pump within the inner circumference of the hollow camshaft moveable through the shift collar for compressing the volume of fluid in the camshaft;

wherein axial movement of the shift collar moves the hydraulic pump to compress the volume of fluid in the camshaft and force the volume of fluid within the camshaft to flow to the phaser.

2. The variable cam timing system of claim 1, further comprising a pressure relief mechanism for releasing pressure within the volume of fluid in the camshaft.

3. The variable cam timing system of claim 1, wherein the fluid sent to the phaser at a compressed pressure is sent at engine startup.

4. The variable cam timing system of claim 1, wherein the fluid is sent to the phaser at a compressed pressure at a time other than engine startup.

5. The variable cam timing system of claim 1, wherein the phaser further comprises a lock pin received within the phaser having a locked position in which a housing of the phaser is locked relative to a rotor assembly of the phaser and an unlocked position.

6. The variable cam timing system of claim 5, wherein the fluid is sent to the phaser at a compressed pressure to move the lock pin from a locked position to an unlocked position.

7. The variable cam timing system of claim 1, wherein the at least one helical track has a first end and a second end separated by a length.

8. The variable cam timing system of claim 7, wherein a first position of the shift collar corresponds to the driven pin being in the first end of the at least one helical track and a second position of the shift collar corresponds to the driven pin being in the second end of the at least one helical track.

9. A variable cam timing system for an internal combustion engine comprising:

a hollow camshaft having a first end and a second end, an outer circumference and an inner circumference, the second end of the camshaft coupled to a phaser;

a shift collar received on the outer circumference of the camshaft, connected to the camshaft through a connecting pin, the shift collar having at least one helical track for receiving a driven pin; and a hydraulic pump comprising:

an outer piston slidably received within the inner circumference of the camshaft, the outer piston having a body with a first end and a second end, the body defining an interior;

a check valve housing within the inner circumference of the camshaft comprising:

a first check valve in fluid communication with a volume defined between the second end of the outer piston, the inner circumference of the hollow camshaft, and the check valve housing through a first passage; and a second check valve in fluid communication with the volume and the phaser through a second passage;

a second spring between the check valve housing and the outer piston;

wherein the shift collar shifts from a first position to a second position, the driven pin rides in the at least one track helical track, the connecting pin pushes against the outer piston, such that fluid in the volume is elevated to a pressure;

when the driven pin is in the helical track in the second position, fluid in the volume is expressed through the second check valve to the phaser at the elevated pressure.

10. The variable cam timing system of claim 9, wherein the pin is driven by a solenoid.

11. The variable cam timing system of claim 9, wherein the compressed pressure expressed to the phaser is 100 to 200 psi.

12. The variable cam timing system of claim 9, wherein the at least one helical track has a first end and a second end separated by a length.

13. The variable cam timing system of claim 12, wherein the first position of the shift collar corresponds to the driven pin being in the first end of the at least one helical track and the second position of the shift collar corresponds to the driven pin being in the second end of the at least one helical track.

14. The variable cam timing system of claim 9, wherein the phaser is a torsion assisted phaser.

15. The variable cam timing system of claim 9, wherein the phaser is a cam torque actuated phaser.

16. The variable cam timing system of claim 9, wherein the phaser is an oil pressure actuated phaser.

17. The variable cam timing system of claim 9, wherein the fluid sent to the phaser at a compressed pressure is sent at engine startup.

18. The variable cam timing system of claim 9, wherein the fluid is sent to the phaser at a compressed pressure at a time other than engine startup.

19. The variable cam timing system of claim 9, wherein the phaser further comprises a lock pin received within the phaser having a locked position in which a housing of the phaser is locked relative to a rotor assembly of the phaser and an unlocked position.

20. The variable cam timing system of claim 19, wherein the fluid is sent to the phaser at an elevated pressure to move the lock pin from a locked position to an unlocked position.

21. The variable cam timing system of claim 9, wherein the hydraulic pump further comprising an inner piston slidably received within the interior of the outer piston, the inner piston having an inlet; and a first spring received within the interior of the outer piston between the outer piston and the inner piston.

22. The variable cam timing system of claim 21, further comprising a stopper in the interior of the outer piston limiting movement of the inner piston within the interior of the outer piston.

23. The variable cam timing system of claim 21, wherein when pressure in the phaser is greater than the pressure of the fluid in the volume, fluid in the volume leaks to the internal combustion engine through the inlet of the internal piston, a vent in the outer piston and a vent in the hollow camshaft.

* * * * *